US005590828A

United States Patent [19]

Stauber

[11] Patent Number: 5,590,828

[45] Date of Patent: Jan. 7, 1997

[54] APPARATUS FOR THE WIRE-STAPLING OF PRINTED PRODUCTS

[75] Inventor: Hans-Ulrich Stauber, Grüt, Switzerland

[73] Assignee: Ferag AG, Switzerland

[21] Appl. No.: 498,359

[22] Filed: Jul. 5, 1995

[30] Foreign Application Priority Data

Jul. 6, 1994 [CH] Switzerland ..... 02 153/94

[51] Int. Cl.[6] ..... B42B 4/02

[52] U.S. Cl. ..... 227/81; 227/86; 227/117; 270/58.08

[58] Field of Search ..... 227/81, 82, 85, 227/86, 87, 91, 114, 117, 118; 270/37, 53, 81

[56] References Cited

U.S. PATENT DOCUMENTS

| | | | |
|---|---|---|---|
| 1,711,960 | 5/1929 | Morris . | |
| 2,364,504 | 12/1944 | Zuckerman . | |
| 3,040,324 | 6/1962 | Worthington et al. . | |
| 3,762,622 | 10/1973 | Noren . | |
| 4,223,823 | 9/1980 | Kutzner et al. | 227/81 |
| 4,512,506 | 4/1985 | Fischer | 227/81 |
| 4,750,661 | 6/1988 | Pane . | |
| 5,098,002 | 3/1992 | Hansch et al. . | |
| 5,113,732 | 5/1992 | Hansch . | |
| 5,172,897 | 12/1992 | Hansch et al. . | |
| 5,342,032 | 8/1994 | Meier . | |
| 5,356,125 | 10/1994 | Hansch et al. . | |
| 5,390,905 | 2/1995 | Melchior | 227/81 |
| 5,464,199 | 11/1995 | Stauber | 227/81 |
| 5,474,221 | 12/1995 | Klinga | 227/81 |

FOREIGN PATENT DOCUMENTS

| | | |
|---|---|---|
| 754923 | 5/1943 | Germany . |
| 1055499 | 4/1959 | Germany . |
| 549443 | 5/1974 | Switzerland . |

*Primary Examiner*—Scott A. Smith
*Attorney, Agent, or Firm*—Brinks Hofer Gilson & Lione

[57] ABSTRACT

The retaining device of a wire-section dispenser has a tongue-like first retaining element and a second retaining element which form boundaries for a gap. The second retaining element can be moved out of a rest position into a clamping position, which narrows the gap, and back again. When the second retaining element is located in the rest position, a stapling wire is advanced into the gap and then fixedly clamped by displacing the second retaining element into the clamping position. A cutting element, which severs the continuous stapling wire into wire sections, is synchronously moved with the second retaining element. The staple guide of a stapling head engages with its carry-along member, the wire section and moves it in the direction of rotation, overcoming the retaining force in doing so.

13 Claims, 5 Drawing Sheets

APPARATUS FOR THE WIRE-STAPLING OF PRINTED PRODUCTS

BACKGROUND OF THE INVENTION

The present invention relates to an apparatus for the wire-stapling of multiple-sheet printed products having a wire section dispenser that includes a wire guide for a continuous stapling wire and a cutting element that cuts the continuous staple wire into staple sized wire sections.

A stapling device of this general type is shown in U.S. Pat. No. 3,762,622. This prior art patent discloses a wire-section dispenser with a wire guide for a stapling wire which is to be advanced in a stepwise manner. There is a cutting element, downstream of the wire guide, along the advancement direction of the stapling wire, which is in the form of a lever. The lever is rotatably driven about an axis that is parallel to the advancement direction of the stapling wire, and has, at its radial end, carry-along teeth which contact the advanced initial region of the stapling wire. There is interaction with a fixed cutter, that severs a wire section from the continuous stapling wire. The wire section is arranged between the radial end of the cutting element and a quarter-circle guide element, and is carried through approximately 90° by the carry-along teeth and is fed to a retaining device. The retaining device has a gap which is bounded by a first retaining element, in the form of a leaf spring, and a stationary second retaining element, in the form of a block, which is adjacent and tangent to rotational path of the carry-along teeth. The retainer moves, along its longitudinal extent, at right angles with respect to the wire section. The wire section is guided into the retainer device, and slide off the carry-along teeth in the process. The wire section is retained under the spring action of the first retaining element. A rotating stapling head has a carry-along member including a carry-along flank which, upon passing the gap, comes into contact with the wire section and delivers the wire section out of the gap. The gap is open downstream, as seen in the movement direction of the carry-along member. A wheel-like rotary bending element is provided downstream of the gap, which is intended to force the wire section carried by the carry-along member into a staple guide of the stapling head. The wire section is simultaneously being formed into a staple. The staple is retained in the staple guide and its legs are then forced out and pushed, through a plurality of paper webs located one upon the other. The legs of the staple are then bent over. In this prior art apparatus, there are jolts of considerable magnitude each time the rotating cutting element comes into contact with the stapling wire. This presents a problem to acceptable operation of this prior art apparatus since the wire section must be accelerated at the same time as the wire is being cut. Also for these reasons the prior art apparatus has a non-smooth operation, it requires a considerable amount of space and it can only process staple wires having a limited selection of diameters.

Another prior art wire-stapling apparatus for multiple-sheet printed products is disclosed in U.S. Pat. No. 4,750,661 and the corresponding European Patent Application EP-A-0205144. This prior art apparatus uses a rotating carrying mechanism, having crossed arms. Stapling heads are mounted at the free ends of the arms and move past a wire guide as the carrying mechanism rotates. Stapling wire is advanced in a stepwise manner through the wire guide and as each. stapling head moves runs past the wire guide, one wire section is severed from the stapling wire by a cutting element arranged on the stapling head. A carry-along member, that is a part of the stapling head, carries the wire section. The wire section is then forced, by a rotatably mounted wheel-like bending element, into a staple guide of the stapling head. The wire section is simultaneously bent to form a staple. When the cutting element contacts the stapling wire, the stapling head is subjected to a considerable jolt, which, in addition to the high stress load that is placed on the mechanism also causes a non-smooth operation.

Therefore it is an object of the present invention to provide an apparatus of the general type that is more compact such that it has a space-saving simple construction and ensures smooth operation.

SUMMARY OF THE INVENTION

According to the invention, the retaining elements can be moved relative to one another from a rest position into a clamping position, which narrows the gap, and back again. This permits the advancement of the stapling wire into the gap in a direction transverse to the longitudinal direction of the gap and the movement direction of the carry-along member. The stapling wire can thus be pushed into the gap directly from the wire guide. Since the wire section is retained by the retaining elements, it can be severed, by the stapling head carry-along member, from the stapling wire before the stapling head comes to rest against the wire section. Consequently, on the one hand, the jolts acting on the stapling head are minimal and, on the other hand, the cutting of the wire can take place independently of the stapling head, with optimum movement progression.

BRIEF DESCRIPTION OF THE DRAWINGS

Problem solutions sought by the invention are provided in the following description, which presents the construction and mode of functioning of a preferred embodiment of the subject matter of the invention that is schematically represented in the following drawings.

DETAILED DESCRIPTION OF THE INVENTION

Figure 1:
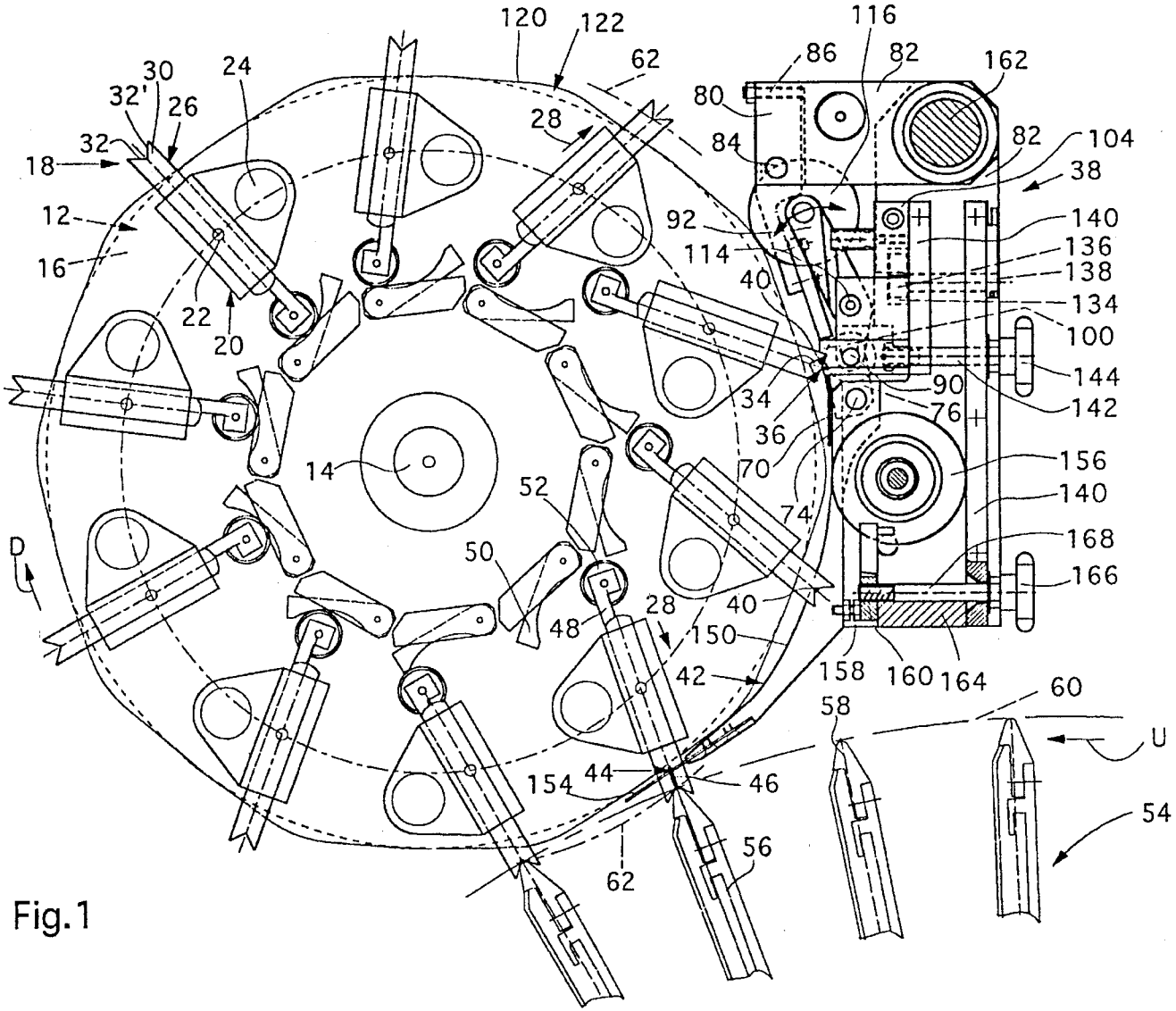
FIG. 1 shows, partly in section, an elevation of stapling heads which are arranged on a rotationally driven carrier and, in order to receive a wire section, are moved past a wire-section dispenser and, in order to bend the wire section to form a staple, are moved past a bending element and, in order to fit the staple into the printed products, are moved along with rests of a collecting drum.
Figure 2:
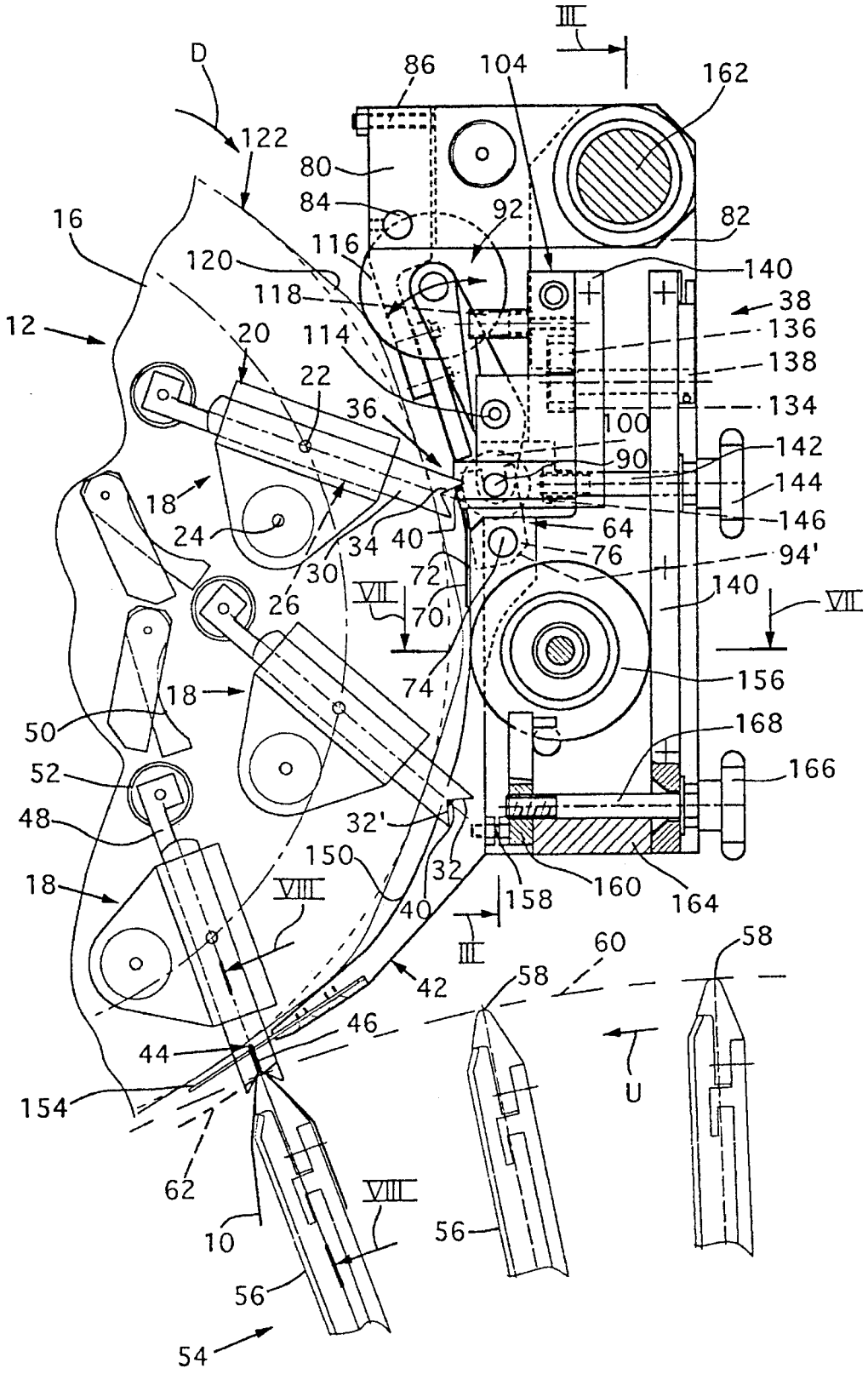
FIG. 2 shows, on an enlarged scale, part of the apparatus shown in FIG. 1.

The apparatus shown in FIG. 1 and in part in FIG. 2 is intended for wire-stapling of multiple-sheet printed products 10. The apparatus includes a stapling-head carrier 12 with a double-walled carrier disk 16 secured to a carrier shaft 14 that is driven in the direction of rotation D. Only one wall of a carrier disk 16 is visible in the FIGS. 1 and 2. Located between the carrier disks 16 are stapling heads 18 that are arranged in the form of a star. The housings 20 of the stapling heads 18 are rotatably mounted on the walls of the carrier disks 16 by pins 22. The housings 20 are caused to oscillate about pins 22 as a result of spindles 24 that penetrate the housings 20. The ends of spindles 24 are guided in endless, self-contained control grooves that function to determine the pivot position of the stapling heads 18.

Figure 8:
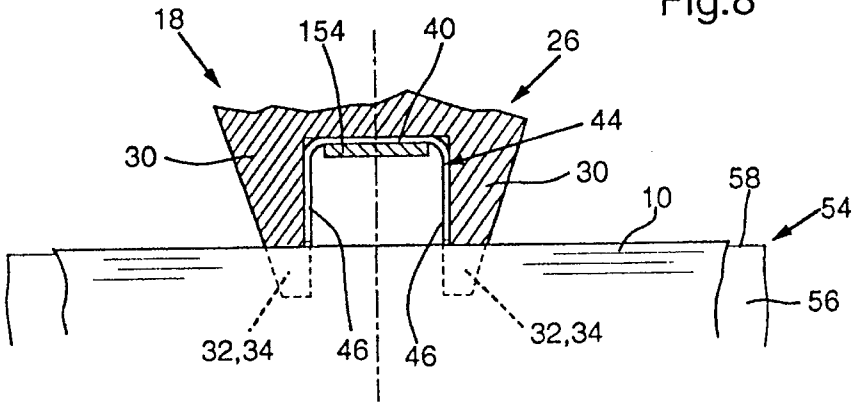
FIG. 8 shows a section, along the line VIII—VIII of FIG. 2, through part of a stapling head seated on a rest of the collecting drum.

In each housing 20, a staple guide 26 is mounted such that it can be displaced to a limited extent in and counter to the direction of the arrow 28. The staple guide 26 is spring-loaded in the direction of the arrow 28. At its radially outer free end region, the staple guide 26 has a fork formed by legs 30, see also FIGS. 6 to 8. The ends, of the legs 30 have a V-shaped end that is comprised of surfaces 32 and 32'. The trailing surface 32, as seen in the direction of rotation D, forms a flank-like carry-along member 34. The flank-like carry-along member 34, when it moves past a receiving location 36 of a wire-section dispenser 38, comes to rest against a wire section 40 and carries said wire section 40 along with it. To accommodate this purpose, the stapling head 18, when moving past the receiving location 36, has an attitude such that the carry-along member 34 extends approximately in the radial direction. The wire section 40 is pushed into the fork of the staple guide 26 by a guide-like bending element 42. The guide-like bending element 42 is located downstream, in the direction of rotation D, of the receiving location 36. The wire section 40 is thereby bent to form a staple 44, having two staple legs 46. The staple legs 4 lie in longitudinally directed guide grooves formed on the inner side walls of the legs 30.

A push rod 48 is mounted in the staple guide 26 such that it can be displaced in and counter to the direction of the arrow 28. The push rod 48 has, at its radially inner end, a follow-on roller 52 which interacts with a control guide 50.

A collecting drum 54 has wall elements 56 arranged around an axis of rotation, that is parallel to the carrier shaft 14. The radially outer ends of wall elements 56 form saddle-like rests 58 that are parallel to the axis of rotation. The printed products 10 are deposited in a straddling manner one upon the other on the rests 58. The rotational path 60 of the rests 58, driven in the direction of rotation U, and the trajectory 62 of the centering extensions, formed by the end surfaces 32, 32', of the staple guide 26 intersect one another. The pivot position of the stapling heads 18 are controlled such that the staple guides 26, by means of their end surfaces 32, 32', come into contact with the rests 58 in a forwardly inclined position and leave said rests 58 in a rearwardly inclined position. The result of which is that, during the interaction, the staple guides 26 and wall elements 56 are located at least approximately radially with respect to the axis of rotation of the collecting drum 54. When the staple guides 26 and rests 58 make contact the staple guides 26 come to a rest. When the end surfaces 32, 32', engage a multiple-sheet printed product 10, the printed product 10 is resiliently forced against the rest 58. Thus, the printed product 10 is displaced inward with respect to the carrier shaft 14, as a result of which the respective follow-on roller 52 comes to rest against the corresponding control guide 50. As a result of this rearward displacement and simultaneous pivoting of the stapling head 18, the push rod 48 forces the staples 44 out of the stapling-head carrier 12. The staple legs 46, extend through the printed product 10, and are closed by means of bending-over devices arranged in the wall elements 56.

To this extent, the apparatus is disclosed and described in U.S. patent application Ser. No. 08/172,649 and the corresponding European Patent Application that was published under the number 0606555. U.S. patent application Ser. No. 08/172,649 is hereby incorporated herein by reference as a part of this disclosure.

Figure 4:
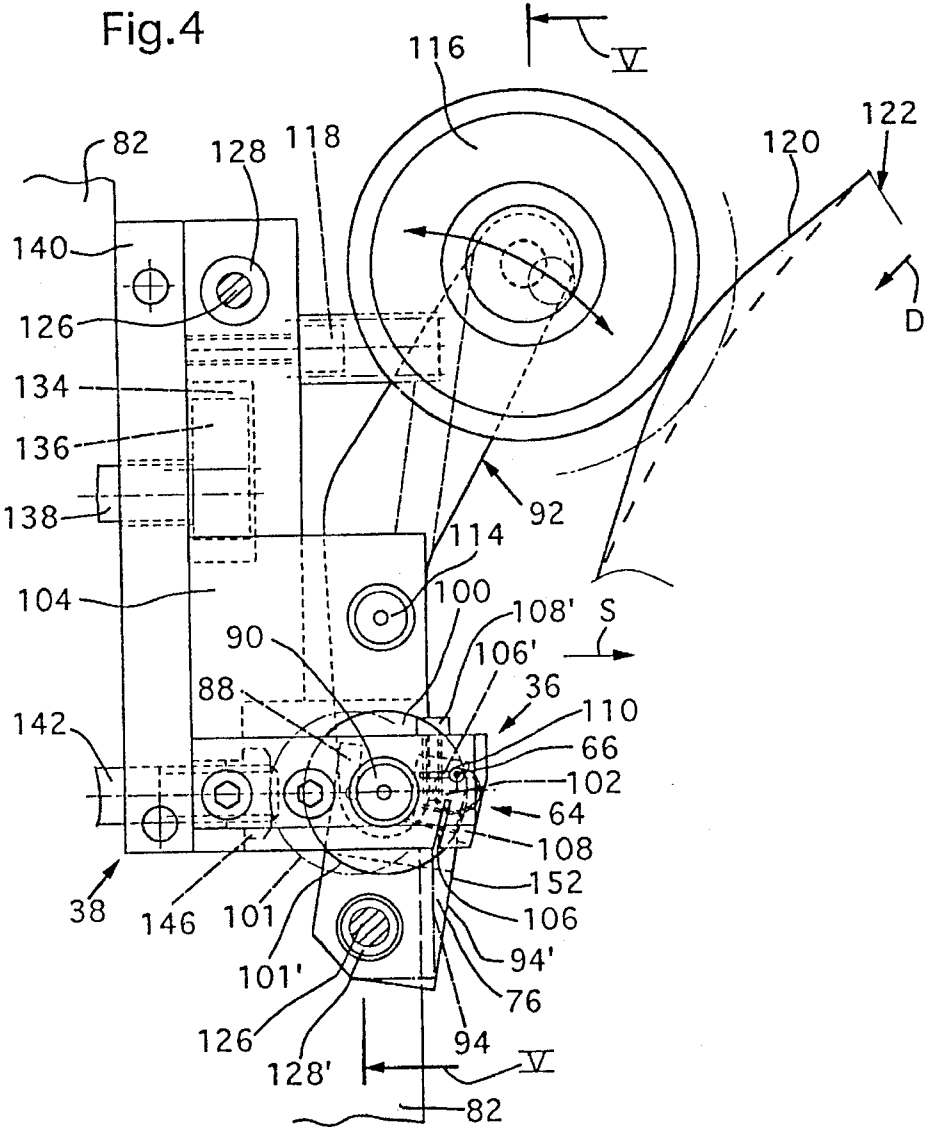
FIG. 4 shows an elevation, in accordance with the arrow IV of FIG. 3, of part of the wire-section dispenser.
Figure 6:
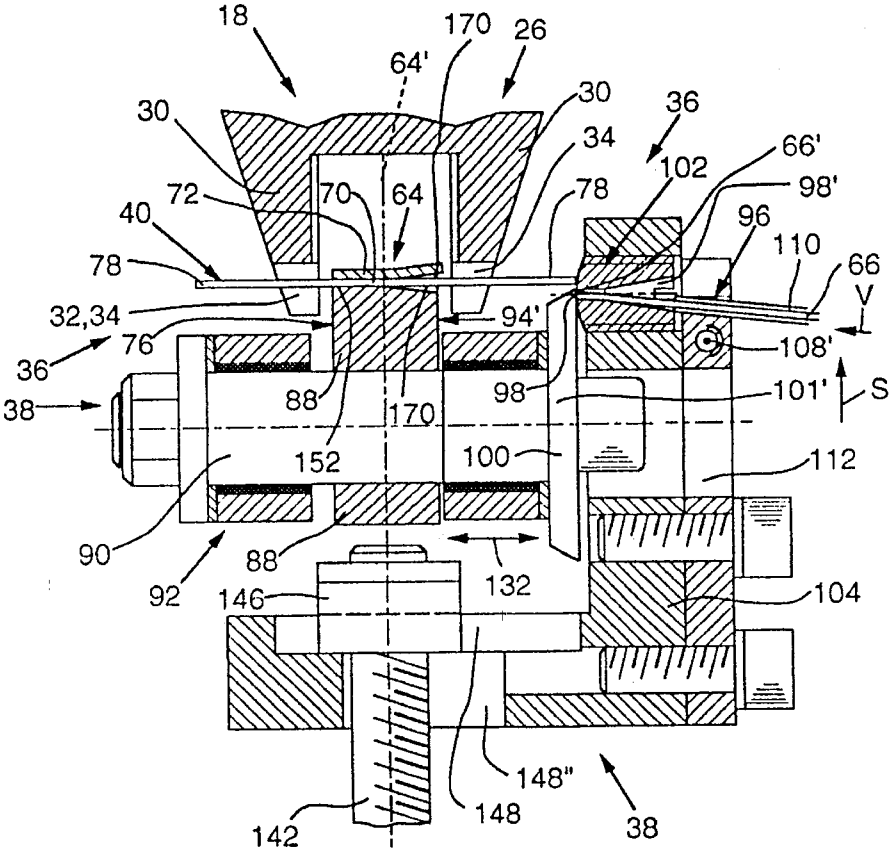
FIG. 6 shows a section through part of the wire-section dispenser along the line VI—VI of FIG. 5, rotated through 180°.
Figure 7:
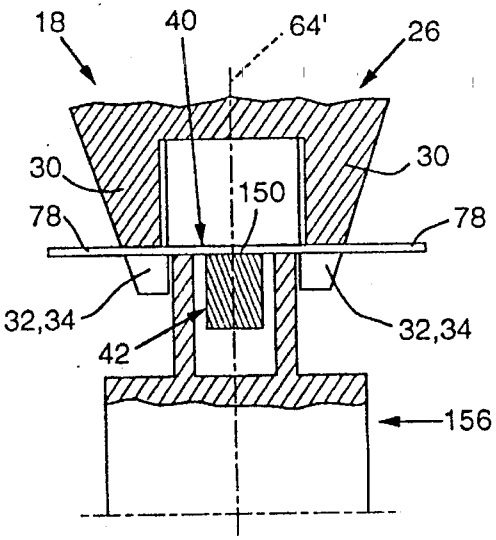
FIG. 7 shows a section through part of the wire-section dispenser along the line VII—VII of FIG. 2, rotated through 90°.

As is shown, in FIG. 2 in conjunction with FIGS. 4 and 6, the wire-section dispenser 38 has, at the receiving location 36, a retaining device 64. The retaining device 64 retains one wire section 40 that is severed from a stapling wire 66 that has been fed to it in the advancement direction V. The wire section 40 engages, through a gap 70. The gap 70 is bounded by a first retaining element 72, designed in the manner of a tongue, and a second retaining element 76 which is mounted such that it can be pivoted about a bearing spindle 74. The bearing spindle 74 extends parallel to the carrier shaft 14. The longitudinal direction of the gap 70 extends essentially at right angles to the wire section 40 and thus in the direction of rotation D. The carry-along members 34 each run through a gap face determined by the gap 70. In other words, the gap face and the trajectory 62 of the carry-along members 34 essentially coincide. The retained wire section 40 projects, by means of its two end regions 78, out of the gap 70, beyond the side borders thereof, and is thus free in certain areas. In the direction of the carrier shaft 14, and thus in the direction of the wire section 40, the widths of the retaining elements 72, 76 are smaller than the distance between the legs 30 of the staple guide 26. As a result that the staple guide 26 can move past the retaining device 64. In this arrangement, the first and the second retaining elements 72, 76 extend into the fork of the staple guide 26. As can be best seen in FIG. 6, the legs 30 of the staple guide 26 are located symmetrically with respect to a center plane 64', which is at right angles to the carrier shaft 14 and passes through the retaining device 64. Center plane 64' is located in the center of the wire-section dispenser 38.

The first retaining element 72, that is designed in the manner of a resilient tongue, is arranged on the side directed toward the carrier shaft 14, with respect to the gap 70. As best seen in FIG. 2, the first retaining element 72 is fastened to a mount 80 that is located upstream with respect to the receiving location 36, as seen in the direction of rotation D. The mount 80 is secured to a panel-like wall elements 82 of the wire-section dispenser 38 such that it can be pivoted about a spindle 84 that is parallel to the carrier shaft 14. The precise pivot position of the panel-like wall element 80 can be adjusted by means of an adjustment screw 86. The free end of the first retaining element 72 is arranged downstream of the receiving location 36, in the direction of rotation D, and simultaneously defines the end of the gap 70, which is thus open downstream and to the sides.

The second retaining element 76, is mounted downstream with respect to the receiving location 36, and is forked at its free end. The forked free end of the second retaining element 76 has tines 88 through which a shaft 90 passes. Shaft 90 is arranged at one end of a two-armed actuating lever 92. The actuating lever 92 allows the second retaining element 76 to be pivoted out of a rest position 94, indicated by chain-dotted lines in FIG. 4, into a clamping position 94', represented by solid lines in FIGS. 2, 4 and 6. When the second retaining element 76 is in the clamping position 94', the gap 70 is narrowed at the receiving location 36 such that the wire section 40 is securely retained, but can be carried along by overcoming the retaining force, without bending, by the carry-along members 34. In the clamping position 94', the gap 70 widens in the manner of a wedge downstream of the receiving location 36, with the result that the retaining force decreases rapidly, with the wire section 40 resting against the carry-along member 34.

In the rest position 94, the two retaining elements 72, 76 are spaced apart from one another by a multiple of the diameter of the stapling wire 66. This allows the leading end 66' of the stapling wire 66 to reliably run in from the side into the gap 70 between the retaining elements 72, 76.

As can be seen in FIGS. 3 to 6, the stapling wire 66 is fed, by means of a wire guide 96, at an acute angle with respect to the gap face, rather than lying precisely therein. Thus, the stapling wire 66, with its leading end 66' in the gap 70, comes into contact with the first retaining element 72 and is deflected slightly thereby. The outlet opening 98 of the wire guide 96 is thus arranged such that it is set back with respect to the first retaining element 72 on the side directed away from the carrier shaft 14 and on the side directed toward a cutting element 100. The disk shaped cutting element 100, can be moved out of a feed position 101, in which the outlet opening 98 is free in the cutting direction S, into a cutting position 101', which is shown by solid lines in FIGS. 4 and 6. During the movement into the cutting position 101', the cutting element 100 is moved past the outlet opening 98 retaining the stapling wire 66, which results in severing of the stapling wire 66 and in the corresponding end region 78 of the wire section 40 being advanced forwards in the cutting direction S. As a result of the inherent elasticity of the stapling wire 66 and the action of the cutting element 100, the wire section 40 is then straight again despite the oblique feeding of the stapling wire 66 with respect to the gap 70.

The outlet opening 98 is arranged in a screw-shank-like adjustment member 102 which is screwed into a cross-sectionally L-shaped carrying element 104. The axis of rotation of the carrying element 104 extends parallel to the gap face. On the side directed toward the cutting element 100, the adjustment member 102 is concave, with the result that end of the wire section 40 which is directed toward the adjustment member 102 is free after the stapling wire 66 has been severed, and the corresponding end region 78 can become straight. As a result of rotating adjustment member 102, it can moved toward or away the cutting element 100. Consequently, it can be precisely adjusted relative to the side of the cutting element 100 which is directed toward it. This precise adjustment results in an extremely clean cut. As can be seen in FIG. 4, the carrying element 104 has a slit 106 which opens into the opening receiving the adjustment member and can be narrowed by means of a screw 108 in order to fix the adjustment member 102.

The through-passage 98' in the adjustment member 102 is, as seen in the advancement direction V, tapers conically toward the outlet opening 98. The terminal end of guide tube 110 is located on the side of the adjustment member 102 adjacent the large diameter of the through-passage 98'. The guide tube 110 extends obliquely, with respect to the axis of the adjustment member 102, and is offset in accordance with the oblique feeding of the stapling wire 66. The guide tube 110 is inserted into a through-passage opening in the retaining plate 112, the retaining plate having a slit 106' which passes through the through-passage opening and can be narrowed by means of a screw 108'. When the screw 108' is tightened the guide tube 110 is thus fixed in place. The retaining plate 112 is fastened on the carrying element 104 such that it can be exchanged, in order, if necessary, to be able to adapt the direction of the stapling wire 66.

The disk-like cutting element 100 is fastened at one end of the shaft 90, around which the second retaining element 76 engages in the manner of a fork. Shaft 90 is arranged on a lever arm of the two-armed actuating lever 92 which is pivotally mounted on the carrying element 104 and on whose other lever arm a follow-on roller 116 is mounted such that it can freely rotate. The axis of rotation 114 of the transmission lever 92 extends parallel to the carrier shaft 14 and shaft 90 and at right angles to the center plane 64'. The actuating lever 92 is pre-stressed by means of a compression spring 118, acting between the carrying element 104 and the lever arm carrying the follow-on roller 116, such that, when the follow-on roller 116 is free, the cutting element 100 is located in the feed position 101, indicated by chain-dotted lines in FIG. 4.

The follow-on roller 116 interacts with an actuating guide 120 which is formed by the outer edge of a plate cam 122 that is fastened to the carrier disk 16. As can be seen in FIGS. 1, 2 and 4, actuating guide 120 has an increase in radius and then a reduction in radius, for each stapling head 18. The result of which is that the cutting element 100 and the retaining device 64 are actuated in a manner precisely synchronized with the movement of the stapling heads 18.

Once the outlet opening 98 is freed by the cutting element 100, the stapling wire 66 is advanced, by means of a schematically indicated advancement device 124, by a specific length and thereby guided into the gap 70. An embodiment of the advancement device 124 is disclosed in U.S Pat. No. 5,113,732 and the corresponding European Application EP-A-0442264. The disclosure of U.S. Pat. No. 5,113,732 is hereby incorporated by reference as a part of this application.

Figure 3:
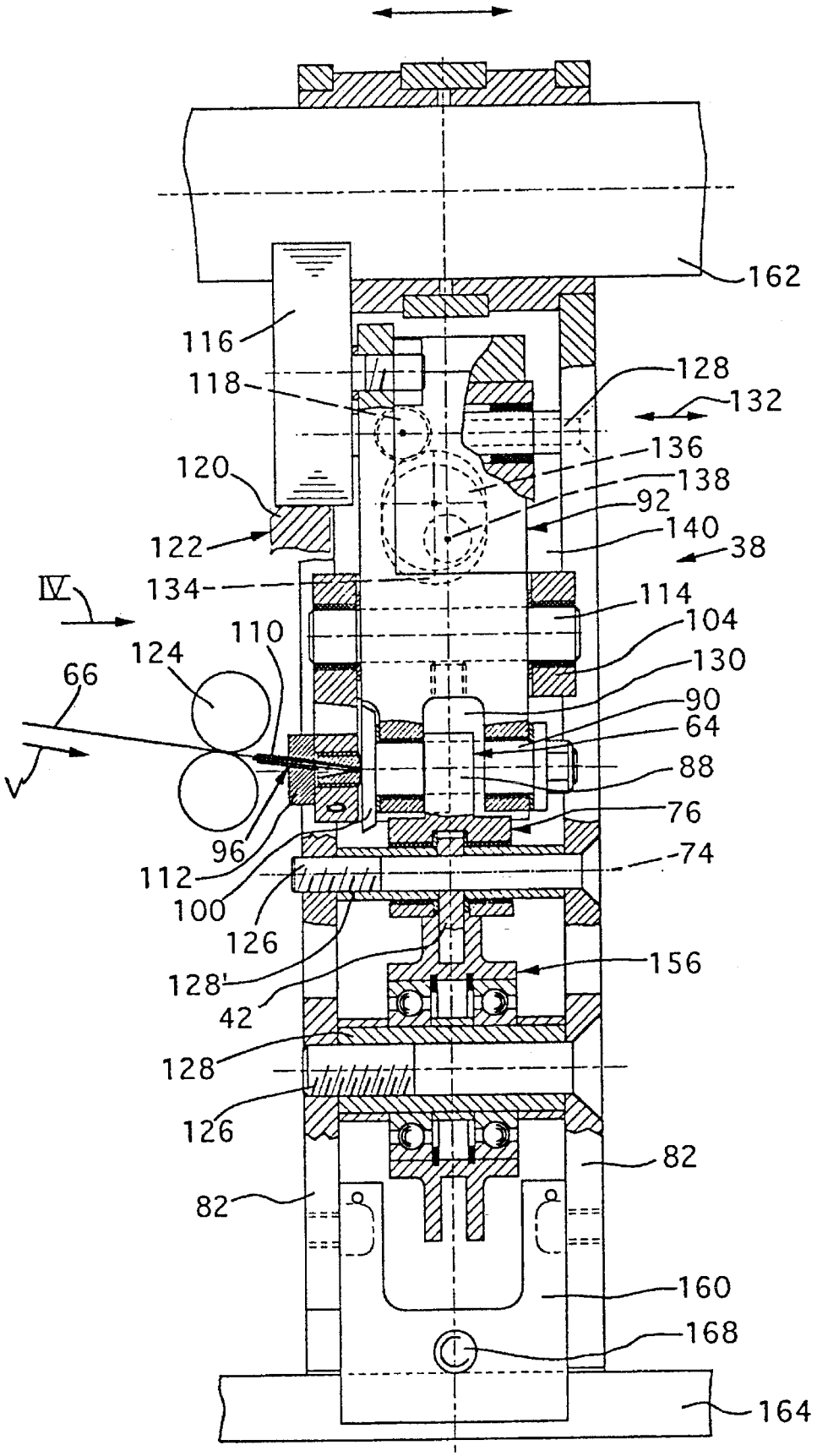
FIG. 3 shows a section through the wire-section dispenser along the line III—III of FIG. 2.
Figure 5:
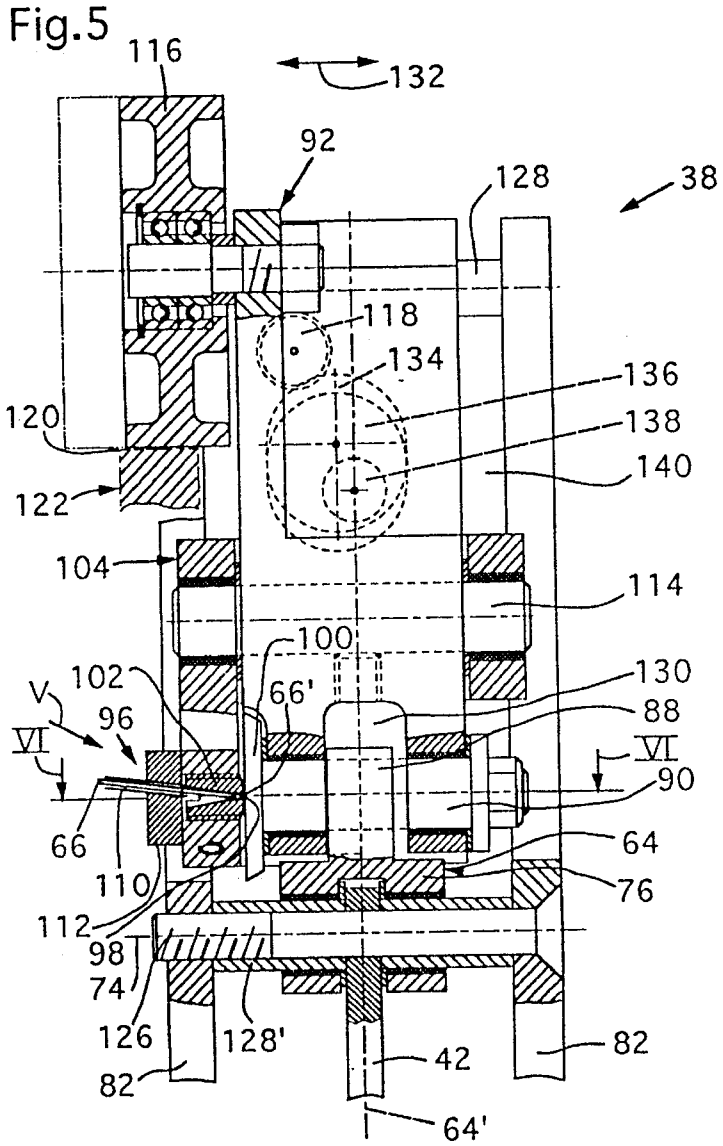
FIG. 5 shows a section through part of the wire-section dispenser along the line V—V of FIG. 4.

As can be seen, in particular, in FIGS. 3 and 5, the wire-section dispenser 38 has two parallel, plate-like wall elements 82 which are fastened to one another by spacer sleeves 128 that are penetrated by screws 126. A bearing sleeve 128', likewise penetrated by a screw 126, forms the bearing spindle 74 of the second retaining element 76. The second retaining element 76 comprises a two part-sleeves that receives therebetween the guide-like bending element 42, which is pivotally mounted on the screw 126 and is centrally retained between the two wall elements 82. Since the second retaining element 76 is rotatably freely seated on the spacer sleeve 128', on both sides of the bending element 42, and extends in the direction of the screw 126, the second retaining element 76 is also retained centrally between the wall elements 82.

In the end region directed toward the shaft 90, the actuating lever 92 is designed in the form of a fork having a clearance 130. The second retaining element 76 extends into the clearance 130 where it extends around the shaft 90. When measured in the longitudinal direction of the shaft 90, the clearance 130 is larger than the second retaining element 76 is in this region. This permits the displacement of the carrying element 104 together with the actuating lever 92, the cutting element 100 mounted thereon, and the wire guide 96 in the direction of the shaft 90 and thus parallel to the carrier shaft 14. If these parts are arranged as is shown in FIGS. 5 and 6, namely such that the cutting element 100 is located at a minimal distance from the center plane 64' of the wire-section dispenser 38, short wire sections 40 are processed, with the result that the staples 44 which are formed exhibit short staple legs 46. Of course, for this purpose, the advancement of the stapling wire 66 is adjusted such that the wire section 40 comes to lie symmetrically with respect to the center plane 64'. If, on the other hand, the carrying element 104 is displaced to the left with respect to the center plane 64', in FIGS. 5 and 6, that is to say is displaced to form a greater distance between the center plane 64' and the cutting element 100, this produces wire sections 40 of a longer length, i.e. staples 44 with longer staple legs 46.

In order to permit the displacement of the carrying element 104, it is mounted on a spacer sleeve 128 such that it can be displaced in the direction of the double arrow 132. It exhibits a slot-like adjustment clearance 134, of which the longitudinal direction runs at right angles to the spacer sleeve 128 and thus at right angles to the double arrow 132. Seated in the adjustment clearance 134 is an adjustment roller 136 which is arranged eccentrically on an adjustment shaft 138, of which the axis lies in the center plane 64'. The adjustment shaft 136 is mounted on connecting plates 140 which extend between the two wall elements 82. By rotating the adjustment shaft 138, the carrying element 104 can thus be displaced back and forth. In order to fix the carrying element 104 in the desired position, it is penetrated by a fixing screw 142 which is mounted on the connecting plate 140. The head of the fixing screw 142 is designed as a hand wheel 144 (see FIG. 1) and on its shank there is seated a nut 146. In order to prevent the co-rotation of nut 146 it is arranged in a depression 148 which extends in the direction of the double arrow 132 and is located in the carrying element 104. Of course, there extends from the depression 148 a slot-like through-passage opening 148', through which the shank of the fixing screw 142 extends. When the screw-connection is tightened, the carrying element 104 is retained in a non-displaceable manner. When the carrying element 104 is retained it rests against one of the connecting plates 140. After said screw-connection has been loosened the carrying element 104 can be adjusted and then fixed again by tightening the screw-connection. Adjustment of the carrying element 104 is accomplished by actuating the adjustment shaft 138.

It can be seen in FIGS. 1 and 2 that the bending element 42 extends from the region of the second retaining element 76 into the region in which in each case one staple 44 is fitted into the printed product 10. The guide surface 150, of the bending element 42, is directed toward the stapling heads 18, and intersects the planar surface 152 in a virtually aligned manner. The planar surface 152 of the second retaining element 76 defines a boundary of gap 70. The first retaining element 72 overlaps the bending element 42 in certain areas and ensures, together with the guide surface 150, continuous guidance for the wire section 40.

The guide surface 150 is shaped such that the wire section 40 is retained securely in the edge region of the end surfaces 32, 32', butting against one another approximately at right angles, of the staple guide 26. Toward the end of the bending element 42, as seen in the direction of rotation D, the distance of the guide surface 150 from the carrier shaft 14 decreases and intersects the trajectory 62. If a stapling head 18, along with its staple guide 26, is moved past said region, the bending element 42 forces the wire section 40 between the legs 30 into the forking, as a result of which a staple 44 is simultaneously formed. Fastened at the end of the bending element 42 is a resilient tongue 154 which is intended to retain the staple 44 in the staple guide 26 at the beginning of the fitting operation. The resilient tongue 154 acts on the web of the staple 44 that connects the staple legs 46 to one another. The resilient tongue 154 exerts a force in a direction counter to the movement direction of the push rod 48 (see FIG. 8).

An adjustment screw 158 is threaded into the bending element 42, such that its head rests against a fastening plate 160. By adjusting the adjustment screw 158, the position of the bending element 42, which can be pivoted about the bearing spindle 74, is adjusted, i.e. the trajectory 62 is drawn nearer or positioned further apart therefrom.

Downstream of the retaining direction 64, in the direction of rotation D, the wire-section dispenser 38 has a press-on wheel 156. The press-on wheel 156 is mounted in a freely rotatable manner. Press-on wheel is intended to engage between the legs 30 of the staple guide 26 of the stapling heads 18 and bending element 42. The press-on wheel 156 functions to force the wire section 44 into the base between the abutting end surfaces 32, 32'. The press-on wheel 156 may, if appropriate, also be dispensed with.

The wall elements 82 are pivotally mounted on a carrying spindle 162 which is fastened on a machine framework (not shown) and runs at right angles to the center plane 64'. The entire wire-section dispenser 38 can thus be pivoted out of the operating position about said carrying spindle 162. As shown in FIGS. 1 and 2, such pivoting would be in the counterclockwise direction into an out-of-operation position. In this out-of-operation position, for example inspection and adjustment work may be carried out. In order to fix the wire-section dispenser 38 in the operating position, provision is made for a bar 164 which runs parallel to the carrying spindle 162 and against which the fastening plate 160 rests on the side directed toward the bending element 42 and one wall element 82 rests on the other side. Said wall element 82 and the fastening plate 160 are clamped with respect to one another by means of a fastening screw 168 which is threaded into the fastening plate 160 and is supported on the wall element 82 by its head. The head of fastening screw 168 is designed as a hand wheel 166. In order to pivot the wire-section dispenser 38, the fastening screw 168 is released by rotating the hand wheel 166, whereupon, by pivoting the fastening screw 168, the fastening plate 160 can be raised over the bar 164. In order to fix the wire-section dispenser 38 in the operating position, the procedure is carried out in reverse order. When the fastening screw 168 is released, the wire-section dispenser 38 can be displaced along the carrying spindle 162 in the direction of the double arrow.

In the rest position 94 of the second retaining element 76, the actuating lever 92 is located in the position indicated by broken lines in FIG. 4. The cutting element 100 is likewise located in the feed position 101. The advancement device 124 is activated and advances the stapling wire 66 by a certain length in the advancement direction V, with the result that the stapling wire 66 passes through the gap 70 and projects beyond the gap 70 on both sides with an approximately equally long end region 78. If a stapling head 18 then comes into the vicinity of the receiving location 36, the actuating lever 92, is pivoted in the clockwise direction as seen in FIGS. 1 and 2 and in the counterclockwise direction as seen in FIG. 4. This pivoting is caused by the action of the actuating guide 120 rotating with the stapling heads 18. As a result of this pivoting, on the one hand, the second retaining element 76 is transferred into the clamping position 94' and, on the other hand, a wire section 40 is severed from the stapling wire 66 by means of the cutting element 100. The stapling wire 66 is severed after the retaining device 64 fixedly clamps the advanced stapling wire 66. In this arrangement, the staple guide 26, along with its carry-along member 34 arranged on the legs 30, runs onto the end regions 78 of the wire section 40 and carries these along in the direction of rotation D. Since the gap 70 comes into the proximity of the trajectory 62, as seen in the direction of rotation D, the wire section 40, during the carry-along operation, is moved into the base of the abutting end surfaces 32, 32'. This is assisted by the press-on wheel 156, if one is present. During a further movement of the stapling heads 18, a staple 44 is then formed, as described above, by the wire section 40 being forced into the staple guide 26, which staple 44 is then fitted into the printed product 10.

The legs 30 can act as magnets in the region of the abutting end surfaces 32, 32', in order to retain the wire section 40. In this case, it is not necessary for the bending element 42 to extend away from the retaining device in order, with its guide surface 150, to retain the wire section 40 between the end surfaces 32, 32'. In this case, the bending element, which could also be designed as a bending wheel, could be spaced apart from the retaining device 64.

In order to ensure that the stapling wire 66 is guided into the gap 70 by means of its leading end 66', even though the stapling wire 66 not be straight, the first retaining element 72 may exhibit a guide depression 170 formed by a bent-out portion, and the second retaining element 76 may exhibit a guide depression 170 formed by a clearance. The depressions 170 would taper on all sides toward the center plane 64', as seen in the advancement direction V.

It is also contemplated that the stapling heads and their carrying elements could be of the design, that is disclosed for example in U.S. Pat. Nos. 5,172,897 and 5,356,125 and the corresponding European Applications EP-A-0399317 and EP-A-0476718. U.S. Pat. Nos. 5,172,897 and 5,356,125 are hereby by reference included as a part of this application.

While the invention has heretofore been described in detail with particular reference to illustrated apparatus, it is to be understood that variations, modifications and the use of equivalent mechanisms can be effected without departing from the scope of this invention. It is, therefore, intended that such changes and modifications be covered by the following claims, including all equivalents.

What is claimed is:

1. An apparatus for wire-stapling of multiple-sheet printed products comprising:

a movable stapling head including a carry-along member;

a wire-section dispenser mounted adjacent to said movable stapling head, said wire-section dispenser including a wire guide for guiding a length of stapling wire that is adapted to be advanced in a stepwise manner along its longitudinal direction, a cutting element located downstream of said wire guide, in the advancement direction of said stapling wire, said cutting element functioning to sever individual wire section from the advancing stapling wire, a retaining device including retaining elements that define a gap for receiving said severed wire sections, said retaining elements being mounted on said wire-section dispenser such that they can move relative to one another from a rest position to a clamping position and back again, such that when said retaining elements are in said clamping position said gap has been narrowed, said retaining device being arranged with respect to said wire guide such that the stapling wire moves with its leading end first, between the retaining elements which are in said rest position, and the retaining elements are then moved into the clamping position, before the cutting operation is performed;

said wire sections adapted to lie freely within said gap with a region outside the gap and to be carried along by said carry-along member of said stapling head, said stapling head is adapted to move past said retaining device in a direction that extends transverse with respect to the position of said wire section in the gap, such that action is performed on said free region of said wire section and said wire section is moved out of said gap which is open downstream in the movement direction.

2. The apparatus as claimed in claim 1, wherein the cutting operation is completed before, and at least one of the retaining elements is moved out of the clamping position after, the carry-along member contacts said severed wire section.

3. The apparatus as claimed in claim 1, wherein a first of said retaining elements is fixed with respect to said wire-section dispenser and is in the form of a resilient tongue, and a second of said retaining elements is mounted such that it can be moved out of said clamping position adjacent to the first retaining element into said rest position further removed from said first retaining element and back again.

4. The apparatus as claimed in claim 1 wherein, when said retaining elements are in said clamping position said gap is wedge shaped in the movement direction.

5. The apparatus as claimed in claim 3, wherein the second retaining element is pivotally mounted.

6. The apparatus as claimed in claim 1, wherein one of said retaining elements has a guide depression formed therein which widens the gap in a region directed toward said wire guide.

7. The apparatus as claimed in claim 1, wherein a retaining element and said cutting element are connected such that they are driven together.

8. The apparatus as claimed in claim 1, wherein said cutting element is connected to a transmission element which interact with a drive member which is connected to and moves with said stapling head.

9. The apparatus as claimed in claim 8, wherein said cutting element is disc shaped and wherein said transmission member includes a lever on which said disc shaped cutting element and a follow-on member that interacts with said drive member are mounted.

10. The apparatus as claimed in claim 1, wherein there are a plurality of movable stapling heads which are arranged in the manner of a star on a rotationally driven carrier and together with their carry-along members, are moved past a common wire-section dispenser in order to receive severed wire sections.

11. The apparatus as claimed in claim 10, wherein said cutting element is connected to a transmission element which interact with a drive member which is connected to and moves with said stapling head and wherein said drive member includes an actuating guide which is fixed to and moves with said carrier.

12. The apparatus as claimed in claim 1, wherein said staple head includes a staple guide and wherein a bending element, is secured to said carrier, said bending element interacts with said staple guide to force said severed wire sections that are being carried along by said carry-along member into said staple guide, and said severed wire section being simultaneously bent over to form a staple.

13. The apparatus as claimed in claim 12, wherein said bending element includes a guide surface, said guide surface being directed toward said stapling head, said guide surface intersects with the surface defined by said retaining element that defines said gap, said retaining element being located on the same side as said bending element with respect to the trajectory of the carry-along member, and is in alignment with said surface to form a continuous guide for said severed wire section that are being carried along.

* * * * *